US005584133A

United States Patent [19]

Motooka et al.

[11] Patent Number: 5,584,133

[45] Date of Patent: Dec. 17, 1996

[54] BASEBALL BALL CATCHING IMPLEMENTS

[75] Inventors: Ken Motooka; Yuko Okada; Junichi Dogan; Masaki Terashita, all of Osaka, Japan

[73] Assignee: Mizuno Corporation, Osaka-Fu, Japan

[21] Appl. No.: 408,421

[22] Filed: Mar. 21, 1995

[30] Foreign Application Priority Data

Mar. 23, 1994 [JP] Japan ..... 6-078061
Feb. 8, 1995 [JP] Japan ..... 7-044739

[51] Int. Cl.[6] ..... G02B 5/12

[52] U.S. Cl. ..... 40/299; 40/586; 2/160

[58] Field of Search ..... 40/299, 636, 642, 40/586, 611, 618, 152, 152.1, 159; 2/19, 160, 246; 21/160

[56] References Cited

U.S. PATENT DOCUMENTS 711,844 10/1902 Fortescue ..... 2/160
1,416,653 5/1922 Lenneberg ..... 2/160
1,797,116 3/1931 Barben ..... 2/19
2,796,680 6/1957 Wittcoff ..... 20/329 X
4,837,960 6/1989 Skaja ..... 40/636
4,863,239 9/1989 Malone ..... 2/160 X

*Primary Examiner*—Kenneth J. Dorner
*Assistant Examiner*—Cassandra Davis
*Attorney, Agent, or Firm*—Keck, Mahin & Cate

[57] ABSTRACT

A baseball ball catching implement has a name plate fitting of rubber or synthetic resin having elasticity affixed to a back member of the implement at any desired position. The implement includes a name plate removably fitted in the name plate fitting. The name plate fitting includes a frame member having a contour corresponding to that of a name plate. The frame member includes an annular inward ledge arranged to define an annular step for receiving and retaining the name plate at its periphery, an annular outward ledge at the top of the frame member and an annular base portion extending outwardly from the lower end of the frame member beyond the ledge. The ledge and the base portion define an outwardly opening annular recess therebetween arranged to receive an edge defining a hole in the back member of the baseball ball catching implement. The annular base portion and the back member are connected to each other by stitches or in any other suitable way.

3 Claims, 4 Drawing Sheets

BASEBALL BALL CATCHING IMPLEMENTS

This invention relates to baseball ball catching implements and, more particularly, to such a ball catching implement having a name plate fitting to which a name plate having a player's uniform number, playing position or name thereon is removably affixed.

It has been known to embroider a player's uniform number, playing position or name directly on a baseball or softball ball catching implement, ice hockey gloves or various protectors, or to indicate such information on a name plate in ink or paint and then affix the name plate to the sports implement.

In case of baseball, the uniform number and/or playing position may change due to a change in organization of a baseball team. If the uniform number and/or playing position is embroidered on a leather member on the back of the ball catching implement, it is very difficult to change the indication. In case of the embroidery, a sheet of leather is cut into a part of a back member in manufacturing the ball catching implement and then, the cut back member part is carried to a embroidery factory where the uniform number or playing position is embroidered on the back member part. This is a time-consuming process. In case of the use of ink or paint, it is difficult to erase the indication on the name plate. Thus, it is desired that the player's uniform number, playing position, or name can be easily exchangeably indicated on the baseball implements.

It has been proposed in Japanese Utility Model Publication Hei.1 (1989)-22683 to removably affix a name plate to a baseball glove.

The name plate includes a narrow integral strap extending through slots in the baseball glove on its back to tie the name plate to the glove. The name plate of this type forms an obstruction to play and, particularly, has a disadvantage in that it can get caught in spikes in touching play.

An object of the invention is to provide a baseball ball catching implement with a name plate fitting of rubber or synthetic resin having elasticity, affixed to a back member of the implement at its any desired position, and including a name plate removably fitted in the name plate fitting.

According to the invention, there is provided a baseball ball catching implement comprising a name plate fitting affixed to a back member of the implement and including a frame member formed from elastic rubber or synthetic resin and having a contour corresponding to that of a name plate. The frame member includes an annular inward ledge arranged to define an annular step for receiving and retaining the name plate at its periphery, an annular outward ledge at the top of the frame member and an annular base portion extending outwardly from the lower end of the frame member beyond the ledge. The ledge and the base portion define an outwardly opening annular recess therebetween arranged to receive an edge defining a hole in the back member of the baseball ball catching implement. The annular base portion and the back member are connected to each other by stitches or any other suitable means.

When it is desired to insert in the step of the frame member, the name plate having a player's uniform number, playing position, or name indicated thereon, the inward ledge of the frame member formed from elastic rubber or synthetic resin can be deformed and enlarged outwardly to facilitate insertion of the name plate into the step of the frame member and, then, the outward force is released to return the inward ledge to its original position, thereby elastically retaining the name plate in the step of the frame member.

The name plate can easily be replaced with a new name plate by removing the former from the frame member in a reverse procedure and inserting the latter into the frame member in the manner as described previously.

The above and other objects and advantages of the invention will become apparent from the following description of embodiments thereof, which are shown in the accompanying drawings in which.

The invention will now be described in more detail by way of an example with reference to the accompanying drawings showing embodiments of a baseball implement for catching a ball.

Figure 1:
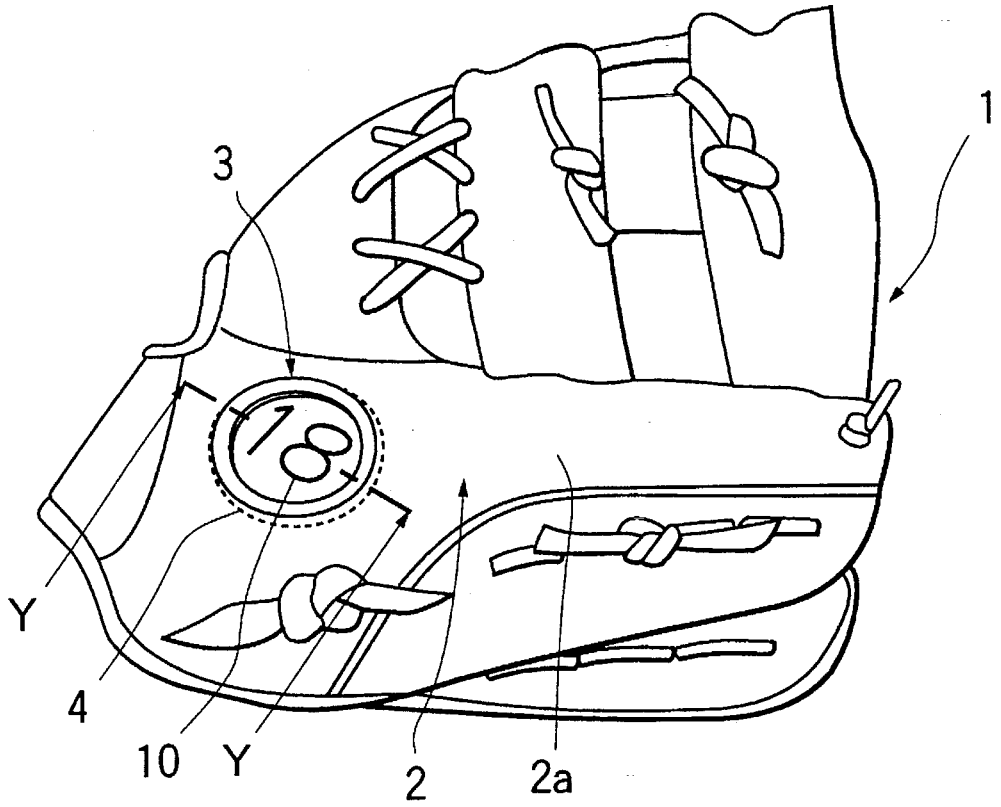
FIG. 1 is a perspective view of a baseball glove with a name plate fitting embodying to the invention.
Figure 2:
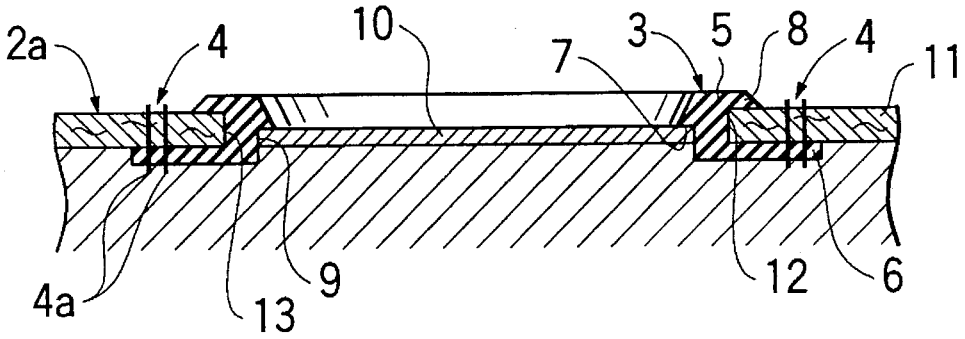
FIG. 2 is an enlarged view of the name plate fitting in section taking along line Y—Y of FIG. 1.

First, FIG. 1 shows the ball catching implement 1 in the form of a baseball glove with a name plate fitting 3 which is shown in detail in FIG. 2. The name plate fitting 3 comprises a frame member 5 formed from elastic rubber or synthetic resin and having a contour corresponding to that of a nameplate 10. The frame member 5 includes an annular inward ledge 7 arranged to define an annular step 9 for receiving and retaining the name plate at its periphery, an annular outward ledge 8 at the top of the frame member 5 and an annular base portion 6 extending outwardly from the lower end of the frame member beyond the ledge 8, the ledge 8 and the base portion 6 defining an outwardly opening annular recess 12 therebetween.

The elastic rubber or synthetic resin of the frame member 5 consists of natural rubber, urethane rubber, soft polypropylene or the likes.

Next, it is described hereinbelow how the name plate fitting according to the present invention is attached to the back of the baseball glove 1. The name plate fitting may be at any desired position of the back of the glove 1 but is located on a portion of the glove which comes into little contact with the ground, for example, either on the back portion of the thumb of the glove 1 as shown in FIG.1 or on a back belt 14 of the glove as shown in FIG.3.

Referring to FIG. 1, the glove 1 includes a ball receiving portion 2*a* and a back member 2 which may be of leather, synthetic resin, fabric or mesh materials. In this embodiment, the back member 2 is formed by cutting a sheet of leather 11 into the shape of the thumb. A hole 13 is formed in the leather member 11 and has a dimension substantially corresponding to that of the frame member 5 of the name plate fitting 3.The frame member 5 is inserted from the underside of the leather member 11 into the hole 13 in the leather member 11 and at this point, a portion of the leather member 11 around the hole 13 is tightly received in the annular recess 12 while the backing portion 6 of the frame member engages the lower surface of the leather member. The outward base portion 6 of the frame member 5 and the leather member 11 are secured to each other at 4, by means of stitches 4*a*. Any other suitable means such as adhesive or a combination of the stitches and adhesive may be used.

Figure 3:
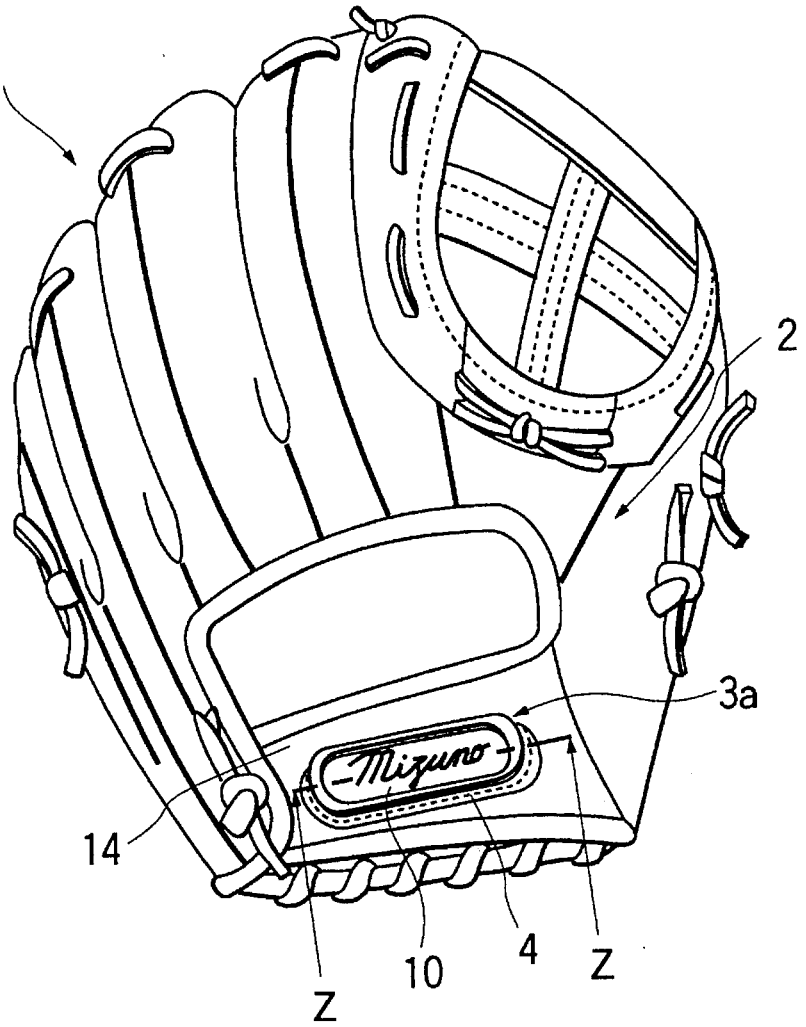
FIG. 3 is a perspective view of a baseball glove with another name plate fitting embodying to the invention.

FIG. 3 shows a baseball glove 1 having a back belt 14 on which the name plate fitting 3*a* according to the invention is disposed. In this embodiment, the nameplate fitting 3*a* comprises a frame member 5 formed from elastic rubber or synthetic resin and having a contour corresponding to that of a name plate 10. The frame member 5 includes an annular inward ledge 7 substantially similar to that of the first embodiment and arranged to define an annular step 9 for receiving and retaining the name plate at its periphery and an annular base portion 6 extending outwardly from the lower end of the frame member.

The frame member 5 is positioned on the upper surface of the back belt 14 and secured to the back belt 14 at 4, by stitching the base portion 6 to the back belt 14 at 4*a*. It will be noted that any other suitable means such as adhesive or a combination of the stitches and adhesive may be used.

Figure 4:
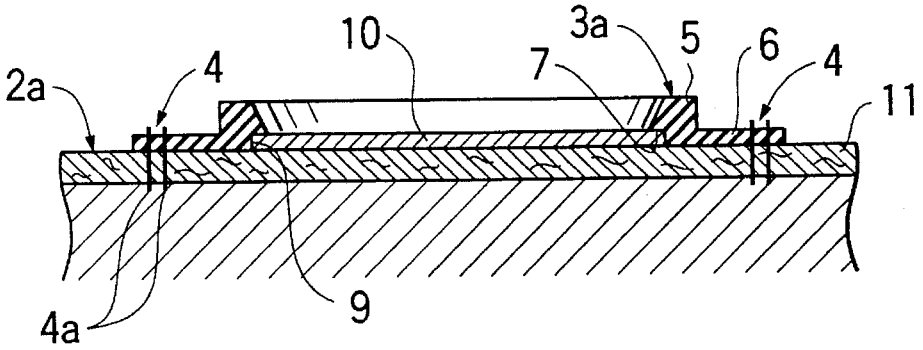
FIG. 4 is an enlarged view of the name plate fitting in section taking along line Z—Z of FIG. 3.
Figure 5:
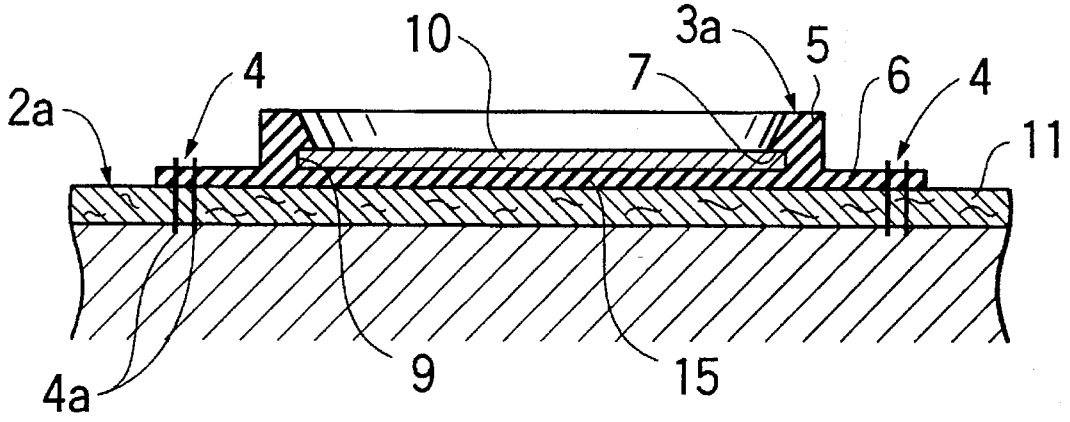
FIGS. 5 through 8 are cross-sectional views of other name plate fittings embodying to the invention.
Figure 6:
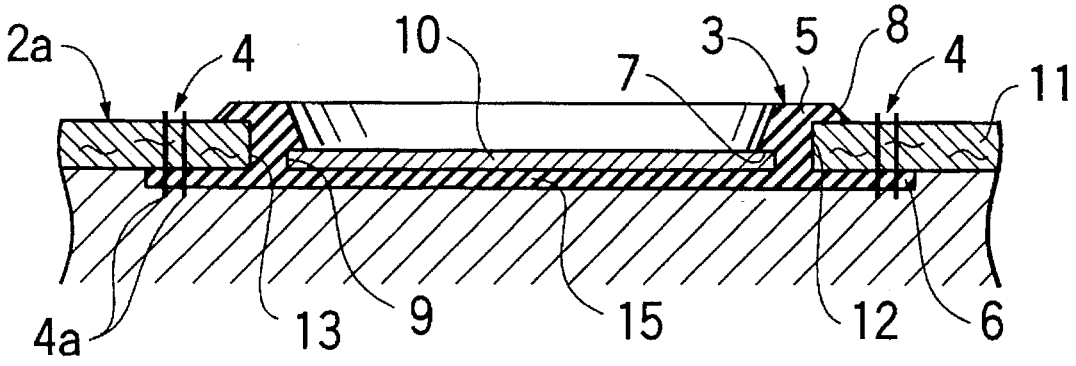

FIGS. 5 and 6 show nameplate fittings each having a bottom 15 formed integrally with each of the frame members as shown in FIGS. 4 and 2, respectively and serving to prevent the name plate from moving toward the inside of the glove.

Figure 7:
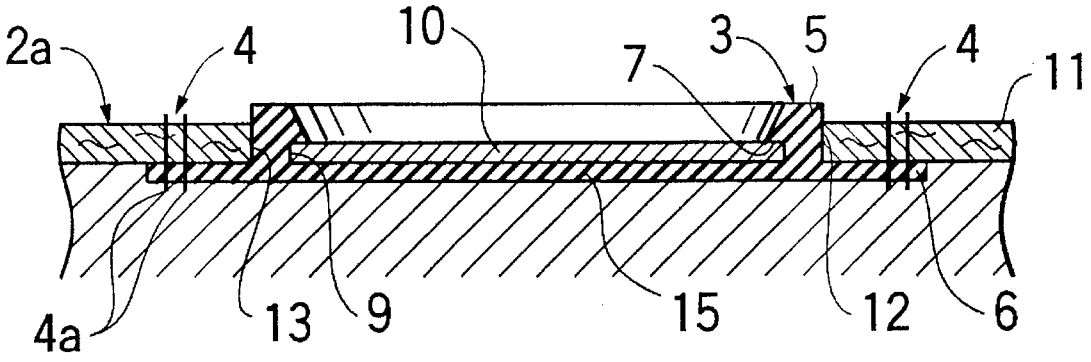

Referring to FIG. 7, the nameplate fitting 3 comprises a frame member 5 having a contour corresponding to that of the name plate 10. The frame member 5 includes an annular inward ledge 7 arranged to define an annular step 9 for receiving and retaining the name plate at its periphery, an annular base portion 6 extending outwardly from the lower end of the frame member and a bottom 15 formed integrally with the outward base portion. The frame member 5 is received in a hole 13 formed in the back leather member 2*a* at any desired position with the outward base portion 6 in engagement with the lower surface of the back leather member 2*a*. The outward base portion 6 and the back leather member 2*a* are secured to each other at 4 by means of stitches 4*a* as shown in FIG. 7 or any other suitable means such as adhesive.

Figure 8:
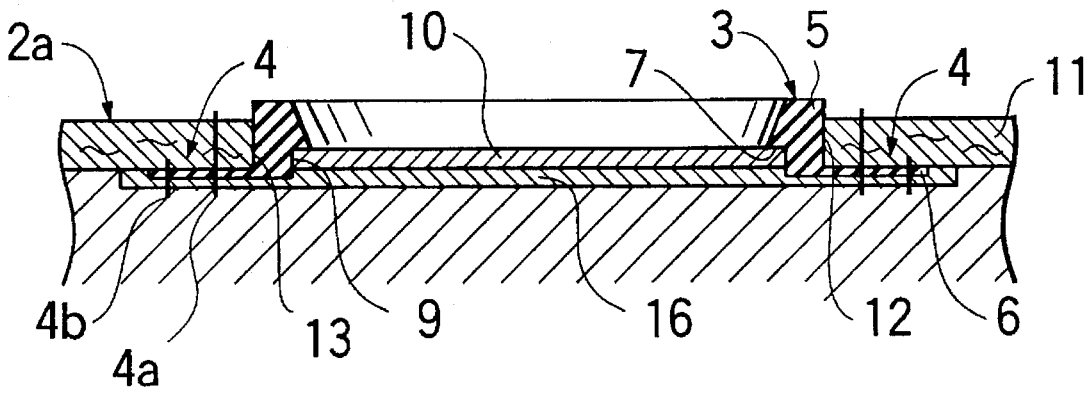

Referring FIG. 8, the nameplate fitting 3 comprises a frame member 5 having a contour corresponding to that of the name plate 10 and including an annular inward ledge 7 arranged to define an annular step 9 for receiving and retaining the name plate at its periphery, an annular base portion 6 extending outwardly from the lower end of the frame member and a backing plate 16 positioned Under and stitched to the outward base portion 6 at 4*b*. The frame member 5 is received in a hole 13 formed in the back leather member 2*a* at any desired position with the outward base portion 6 and the backing plate 16 in engagement with the lower surface of the back leather member 2*a*. The outward base portion 6 and the backing plate 16 are secured to the back leather member 2*a* at 4 by means of stitches 4*a* as shown in FIG. 8 or any other suitable means such as adhesive.

The name plate 10 may be of a piece of fabric, leather or metal on which a uniform number, playing position's name, or player's name can be borne. The name plate 10 may be covered with a plate or film of transparent resin to protect the name plate 10 from any contamination.

When it is desired to insert in the step of the frame member the name plate having a player's uniform number, playing position, or name indicated thereon, the inward ledge of the frame member formed from elastic rubber or synthetic resin elastic rubber or synthetic resin can be deformed and enlarged outwardly to facilitate insertion of the name plate into the step of the frame member and then, the outward force is released to return the inward ledge to its original position, thereby elastically retaining the name plate in the step of the frame member.

The name plate can easily be replaced with a new name plate by removing the former from the frame member in a reverse procedure and inserting the latter into the frame member in the manner as described previously.

It will be noted from the foregoing that a player can indicate his uniform number, playing position, or name on the name plate and affix it to his ball catching implement for the purpose of distinguishing it from other player's implements. The player can also change from one indication to another indication by replacing a name plate.

What is claimed is:

1. A baseball ball catching implement comprising:

a name plate fitting formed from elastic material;

a back member to which said name plate fitting is affixed;

a name panel removably fitted in the name plate fitting;

a frame member, formed from elastic material and having a contour corresponding to that of said name panel, included on said name plate fitting;

an annular inward ledge included on said frame member and defining an annular step for receiving and retaining the name panel at its periphery;

an annular base portion extending outwardly from a lower end of the frame member;

a backing plate, engageable with an underside of said name panel, positioned under and stitched to the annular base portion, the name plate fitting received in a hole defined in the back member of the baseball ball catching implement so that the annular base portion engages with the back member; and stitches for connecting the annular base portion, the backing plate and the back member to one another.

2. A baseball ball catching implement as defined in claim 1, wherein said elastic material is elastic rubber.

3. A baseball ball catching implement as defined in claim 1, wherein said elastic material is synthetic resin.

* * * * *